United States Patent [19]

Malta

[11] Patent Number: 4,599,932

[45] Date of Patent: Jul. 15, 1986

[54] HANDCHIME WITH ELASTOMERIC HINGE

[76] Inventor: Jacob H. Malta, 21 Bell La., New Britain, Pa. 18901

[21] Appl. No.: 567,655

[22] Filed: Jan. 3, 1984

[51] Int. Cl.[4] ..... G10D 13/06

[52] U.S. Cl. ..... 84/404; 84/410; 116/171; 446/422

[58] Field of Search ..... 84/102–103, 84/402–410; 116/148, 169, 171; 446/397, 418, 421, 422

[56] References Cited

U.S. PATENT DOCUMENTS

| | | | |
|---|---|---|---|
| 716,025 | 12/1902 | Gammell | 84/402 X |
| 855,056 | 5/1907 | Hirschfeld | 84/404 |
| 890,341 | 6/1908 | Deagan | 84/404 |
| 976,718 | 11/1910 | Bartholomae | 446/422 |
| 1,173,507 | 2/1916 | Haskell | 84/410 X |
| 2,153,725 | 4/1939 | Sanders | 84/403 |
| 2,478,549 | 8/1949 | Samet | 84/404 |
| 4,075,922 | 2/1978 | Smith | 84/402 |
| 4,463,517 | 8/1984 | Kerr et al. | 84/402 |

*Primary Examiner*—Lawrence R. Franklin

[57] ABSTRACT

This invention is directed to percussion musical instruments which incorporate striking elements for producing musical sound. The invention discloses a novel hand chime which contains a one-piece elastomeric clapper hinge which accurately controls the swing of the clapper yet is an accoustically "dead" element which does not transmit unwanted vibrations from the chime tines to the clapper. The invention further includes novel adjustable elements such as a clapper bar bumper and a damper which may be adjusted to vary the musical characteristics of the sound. Molded polypropylene has been used successfully as the material for the hinge.

12 Claims, 4 Drawing Figures

FIG. 1
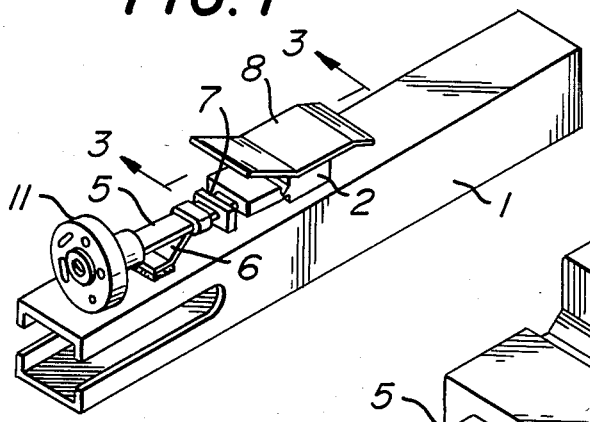
FIG. 4
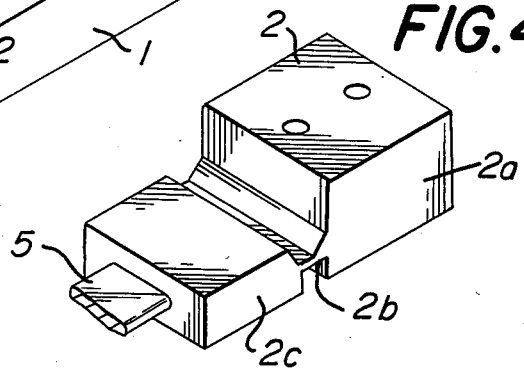
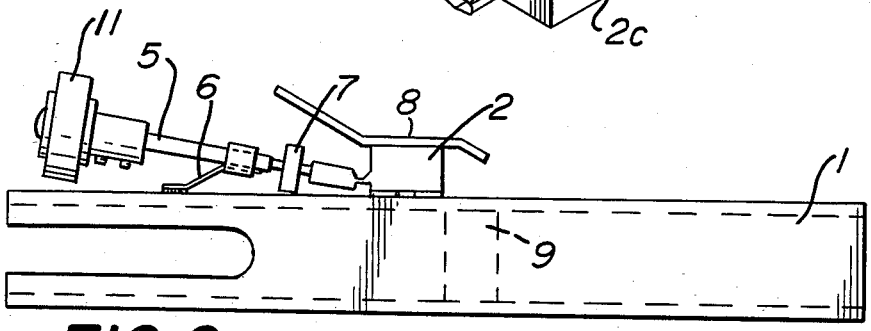
FIG. 2
FIG. 3
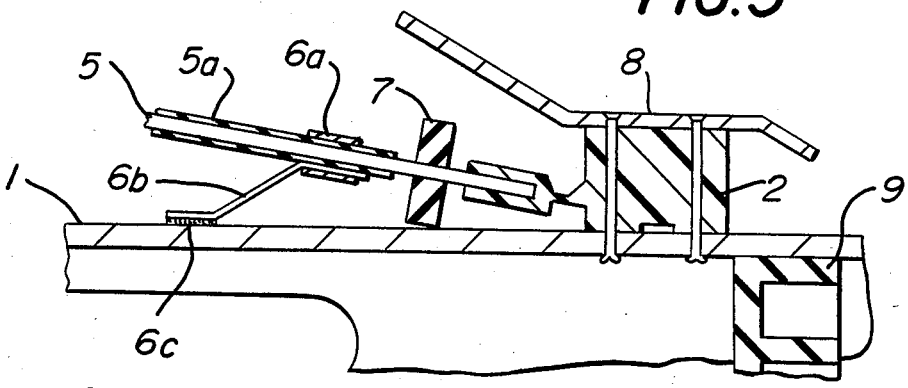

HANDCHIME WITH ELASTOMERIC HINGE

BACKGROUND OF THE INVENTION

1. Field of thc Invention

This invention is directed to percussion musical instruments which incorporate striking elements such as clappers, knockers and hammers which are attached to the main body of the instrument. More specifically, this invention relates to the hinge mechanism which connects the striking element to the main body musical instrument. A preferred embodiment, a novel hand chime is constructed using this hinge mechanism.

2. The Prior Art

Many musical instruments contain strings, bells, timpani and chimes, which are struck by percussive elements to produce their musical tones. In all of these instruments where the striking elements are permanently secured by mechanical means to the body of the instrument there have been many different approaches to the design requirements. It is necessary that the striking member swing freely so that it can generate the necessary impact upon the vibrating member it strikes, and also control its movement so that it performs this function accurately. In the past, most of the connections between the striking elements and the body of the instrument have been simple hinge elements containing yokes and pins. Many of these designs have metal to metal contact and sufficient tolerance between their respective parts so that vibrations in the body of the instrument are often transmitted to these parts at these hinge points producing sound which detracts from the overall musical quality of the instrument.

It is, therefore, one object of the instant invention to devise a hinge mechanism to be used in percussion instruments with striking members that does not adversely affect the musical quality of the instrument.

It is a further object of the instant invention to devise a hand chime which incorporates an acoustically "dead" hinge mechanism which is inexpensive to manufacture and assemble and does not detract from the tonal quality of the instrument.

It is a further object of the instant invention to devise a hand chime which has superior musical qualities and which contains adjustment means for damping its musical qualities and which contains adjustment means for damping its musical tones to allow varying degrees of sustain to its musical sound.

A further object of the instant invention is to create a handheld musical instrument which incorporates an elastomeric hinge between its body and clapper.

SUMMARY

The foregoing objects are achieved by the use of a one-piece molded elastomeric hinge as dimensioned hereinafter and fashioned as a strap hinge with a clapper bar end block and a mounting end block for attachment to the clapper bar and main tube respectively. More specifically, the hinge has a free end, a mounting end and a highly elastic mid-section located between said ends, said mid-section being of rectangular cross-section with a broad lateral dimension and a minimal vertical dimension which is parallel to the arc of the clapper throw. These three elements of the hinge are molded into one piece. This novel hinge is incorporated into a hand chime of the forked-tube style which has various other novel features as will be more specifically pointed out.

The elements of the hand chime comprise the forked-tube, the clapper assembly and the interconnecting elastomeric hinge. The forked-tube is of square cross-section, and material is removed from two opposite surfaces at one end of the tube which creates tines for vibrating by impact of the clapper head. The remainder of the tube is completely hollow end-to-end except for a tuning plug which is positioned inside of the main tube in order to produce an augmenting resonant chamber which enhances the volume and quality of the tone generated by the vibrating tines at the forked end. On the top of the main tube, the mounting end block of the elastomeric hinge is bolted directly thereto and the other end of the hinge is molded to the clapper bar which holds the clapper head assembly. The hinge permits the clapper bar to swing in one plane of motion only. The throw of the clapper bar is controlled by a clapper bar bumper slideably mounted on the clapper bar. It limits the movement of the clapper bar by contacting either the main tube or a clapper bar bumper stop at the extremes of the clapper bar throw. The clapper bar stop is attached above the hinge and fastened directly to the main tube. The resonating section of the main tube also facilitates space for a hand grip and the instrument is played by swinging the instrument and arresting its motion sharply which results in the continued motion of the clapper assembly to impact the forked end of the main support tube.

The hand chime instrument described herein further includes a damper which is slideably mounted on the clapper bar and which is dimensioned so that it will contact the tines at the forked end so that the continued vibration of the tines may be dampened effecting a "shorter" note to be produced with a freely vibrating tine. By sliding its position along the clapper bar and by adjusting the position of the clapper bar bumper, the damping action may be varied in degree producing different tonal qualities. Further adjustment in the timber of the tone can be achieved by the rotation of the adjustable clapper head assembly incorporated in the instant invention and which is described in detail in the previously issued patent to the inventor, U.S. Pat. No. 3,253,574, pertaining to hand bells. The individual adjustability afforded by the clapper bar bumper, the damper and the clapper head assembly together provide a wide variety of tonal quality and control never before achieved in a hand-held percussive musical instrument.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits and scope of the invention disclosed.

IN THE DRAWINGS

FIG. 1 is a perspective view of one embodiment of the musical percussion instrument incorporating the one-piece molded hinge assembly.

FIG. 2 is a side view of the hand chime embodiment.

FIG. 3 is an enlarged cross-sectional view taken along line 3—3.

FIG. 4 is an enlarged perspective view of the one piece elastomeric hinge showing its various elements.

DESCRIPTION OF THE PREFERRED EMBODIMENT

Referring now to the drawings, the principles of the invention are showed as applied to a hand chime, which includes a one-piece main tube of square cross-section 1 with metal cut away at one end to form tines which vibrate under the impact from clapper head assembly 11. The main tube carries within it a tuning plug 9 which is adjusted so that the distance between the end of the tuning plug and the open end of the tube opposite the forked end is equivalent to ¼ of the wave length of the tonal frequency produced by the instrument. All other elements of the instrument are attached to the main tube by direct riveting as illustrated in FIG. 3. The mounting block 2*a* of the molded hinge unit 2 is securely fastened between the thumbrest/bumperstop 8 and the top surface of the main tube 1. The hinge unit 2 includes three features of construction as shown in FIG. 4: the mounting end block 2*a*, a tapered, highly elastic mid-section 2*b* and clapper bar end block 2*c*. Located on the clapper bar 5 nearest the end block is slideable clapper bar bumper 7 which holds the clapper head away from the tine at rest. This distance may be varied by changing the position of the bumper along the clapper bar. Clapper bar 5 is covered by plastic cover 5*a* which carries the damper assembly 6.

FIG. 3 depicts the various elements of the damper mechanism which includes slideable collar 6*a* which is riveted to leaf spring 6*b* to which damper pad 6*c* is affixed so that the damper pad lightly contacts the tine at all times. The clapper head assembly 11 is affixed to the end of clapper bar 5. The striking element of the clapper head is a plastic disc including a multiplicity of molded-in slots and holes of varying sizes, as well as a solid area. The central hole in the clapper head is hexagonal and by selectively positioning the clapper head on the hexagonal extension of the clapper bushing, different areas of the clapper head make contact with the tube when it is struck, thereby differing tone quality or timbers.

In its operation, the instrument is held upright and played by swinging the instrument forward and stopping its movement sharply with a snap of the wrist. The main tube is 1" square aluminum stock which is nicely sized as a handle to be grasped at the resonator end. Clapper bar bumper stop 8 also serves as a comfortable thumbrest. The throw of the clapper is determined by the clapper bar bumper 7. The throw of the clapper and hence the intensity of the note is increased by moving the bumper along the clapper bar toward the clapper head. Similarly, the damper assembly may be moved along the clapper bar to achieve different lengths of ringing time or sustain. The damper leaf spring is a very light guage metal so that light pressure is applied to one of the tines of the chime after the note is struck. A very light pressure of the damper is essential so that no appreciable extra effort is required to overcome spring force in striking the chime. Positioning the damper assembly toward the clapper head brings the pad into contact with the tines closer to the end where the vibrations are greater, therefore, damping occurs more quickly. Positioning it further away from the clapper head places it into contact with the tine where vibrations are smaller and, therefore, damping time is increased. If no damping is desired and it is desired that tone be sustained, the ringer, after striking, need merely hold the chime slightly back toward vertical so that the clapper bar bumper lays against the underside of the bumper stop. This lifts the damper away from the tines. In this way, tonal duration may be controlled.

A further degree of tone adjustment is permitted by the clapper head assembly. If the clapper head is positioned so that the area in front of the longer slot makes contact, a low soft tone results. Rotating the clapper head so that a smaller slot or hole is behind the striking surface increases the brilliance with the maximum brilliance resulting when the solid area is used to strike with. This unique design not only allows an extra degree of adjustment but also permits one clapper head to be used throughout the full range of twenty-five separate tonal instruments thereby aiding the economics of production. This is important because the instrument is manufactured and sold in sets and it is common for a group of instruments, each producing a separate note, to be assembled in a choir played in concert by a group of musicians. The individual notes produced by each instrument are determined by the length of the tine formed at the vibrating end of the main tube and the length of the main tube which is tuned to the frequency of the tine by location of the tuning plug.

It should be understood that the elastomeric hinge unit as described fully herein and applied to a hand chime is only but one application of this novel hinge which provides free movement in only one plane of travel while possessing the beneficial quality of being an acoustic insulator. This hinge can easily be adapted to many other percussion instruments containing striking and vibrating elements assembled in one unit. Furthermore, it will be obvious to those persons of ordinary skill in the art that many changes and modifications may be made to the specific embodiment portrayed herein without departing from the spirit and scope of the invention. For example, the elastomeric hinge may be made from many different materials including, but not limited to, polypropylene.

What is claimed is:

1. A hand chime, comprising:

(a) a main tube of square cross-section having a forked end and a resonator end, said ends being internally partitioned by a tuning plug positioned therebetween;

(b) a one-piece elastomeric hinge affixed to the main tube, said hinge having a clapper bar end block, a mounting end block and a highly elastic mid-section located between said ends, said mid-section being of rectangular cross-section with a broad lateral dimension and a minimal vertical dimension parallel to the arc of the clapper throw such that said hinge bends freely in the vertical plane of motion only; and (c) clapper means affixed to the clapper bar end block of the elastomeric hinge, said clapper means having a clapper bar and a striking end containing a clapper head for striking the forked end of the main tube.

2. The hand chime of claim 1 further including a clapper bar bumper slideably affixed to the clapper bar.

3. The hand chime of claim 2 further including a clapper bar bumper stop affixed to the main tube positioned to contact the top of the clapper bumper as the clapper moves away from the main tube thereby limiting the clapper throw.

4. The hand chime of claim 3 further including a damper slideably affixed to the clapper bar, said damper containing a collar, leaf spring and damper pad.

5. The hand chime of claim 4 wherein the mounting end of the elastomeric hinge is held between the clapper bar bumper stop and the main tube.

6. The hand chime of claim 5 wherein the clapper bar bumper stop contains a thumb-rest.

7. The hand chime of claim 6 further including a plastic sleeve affixed around the clapper bar.

8. The hand chime of claim 7 wherein the main tube is aluminum.

9. The hand chime of claim 8 wherein the elastomeric hinge is molded polypropylene.

10. In a hand chime which produces only one discrete tone or note comprising a hinged striking member and a vibrating member, the improvement comprising; a one piece elastomeric hinge interconnecting the striking member and the vibrating member for controlling the movement of said striking member, said hinge being mounted directly to said vibrating member and of rectangular cross-section with a minimal dimension parallel to the arc of motion of the striking member so that said hinge bends freely in one plane of motion only.

11. A hand chime, comprising:

(a) a main tube having two opposite open ends, (b) the first of said ends being forked and having tines, (c) the second of said ends being suitable for grasping as a handle, (d) an adjustable tuning plug within said main tube between said ends dividing said main tube into two sound chambers, and (e) clapper means affixed to said main tube by an elastomeric hinge for striking said tines.

12. A handchime, comprising:

(a) a main tube having two opposite open ends;

(b) the first of said ends being forked and having tines;

(c) the second of said ends being suitable for grasping as a handle;

(d) an adjustable tuning plug within said main tube between said ends dividing said main tube into two sound chambers, and (e) clapper means for striking said tines, said clapper means being attached to said main tube by hinge means.

* * * * *

REEXAMINATION CERTIFICATE (929th)

United States Patent [19]

Malta

[11] B1 4,599,932

[45] Certificate Issued Sep. 27, 1988

[54] HANDCHIME WITH ELASTOMERIC HINGE

[76] Inventor: Jacob H. Malta, 21 Bell La., New Britain, Pa. 18901

Reexamination Request:
No. 90/001,383, Nov. 27, 1987

Reexamination Certificate for:

| | |
|---|---|
| Patent No.: | **4,599,932** |
| Issued: | **Jul. 15, 1986** |
| Appl. No.: | **567,655** |
| Filed: | **Jan. 3, 1984** |

[51] Int. Cl.[4] ..... G10D 13/06

[52] U.S. Cl. ..... 84/404; 84/410; 116/171; 446/422

[58] Field of Search ..... 84/102–103, 84/402–410; 116/148, 169, 171; 446/397, 418, 421, 422

[56] References Cited

U.S. PATENT DOCUMENTS

| | | | |
|---|---|---|---|
| 527,488 | 10/1894 | Gerry | 84/403 X |
| 644,817 | 3/1900 | Deagan | 84/402 |
| 716,025 | 12/1902 | Gammell | 84/402 X |
| 818,874 | 4/1906 | Deagan | 84/403 X |
| 855,056 | 5/1907 | Hirschfeld | 84/404 |
| 890,341 | 6/1908 | Deagan | 84/404 |
| 976,718 | 11/1910 | Bartholomae | 84/402 X |
| 1,173,507 | 2/1916 | Haskell | 84/410 X |
| 2,153,725 | 4/1939 | Sanders | 84/403 |
| 2,478,549 | 8/1949 | Samet | 84/404 |
| 3,545,329 | 12/1970 | Roehrig | 84/251 |
| 4,075,922 | 2/1978 | Smith | 84/402 |
| 4,463,517 | 8/1984 | Kerr et al. | 84/402 |
| 4,599,932 | 7/1986 | Malta | 84/404 |

OTHER PUBLICATIONS

David Sawyer: "Vibrations", Cambridge University Press, Cambridge, 1977, pp. 24–25.

Malmark Sales Brochure, copyright 1982.

*Primary Examiner*—Lawrence R. Franklin

[57] ABSTRACT

This invention is directed to percussion musical instruments which incorporate striking elements for producing musical sound. The invention discloses a novel hand chime which contains a one-piece elastomeric clapper hinge which accurately controls the swing of the clapper yet is an accoustically "dead" element which does not transmit unwanted vibrations from the chime tines to the clapper. The invention further includes novel adjustable elements such as a clapper bar bumper and a damper which may be adjusted to vary the musical characteristics of the sound. Molded polypropylene has been used successfully as the material for the hinge.

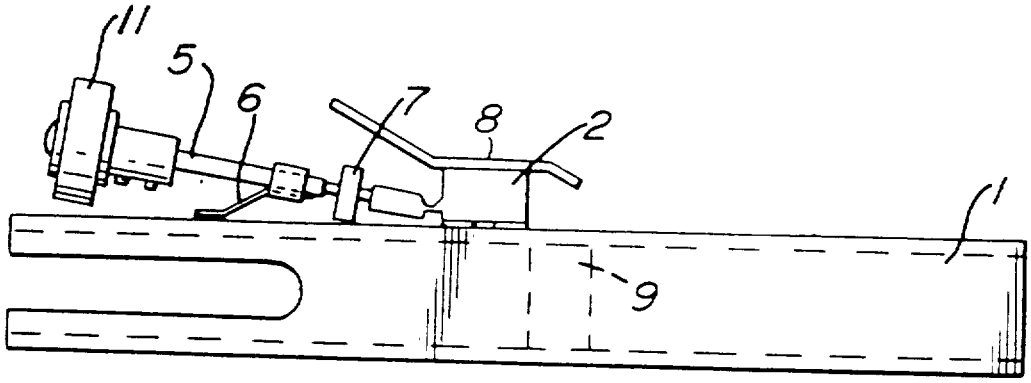

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 42–Col. 4, line 3:

In its operation, the instrument is held upright and played by swinging the instrument forward and stopping its movement sharply with a snap of the wrist. The main tube is 1" square aluminum stock which is nicely sized as a handle to be grasped at the resonator end. Clapper bar bumper stop 8 also serves as a comfortable thumbrest. The throw of the clapper is determined by the clapper bar bumper 7. The throw of the clapper and hence the intensity of the note is increased by moving the bumper along the clapper bar toward the clapper head. Similarly, the damper assembly may be moved along the clapper bar to achieve different lengths of ringing time or sustain. The damper leaf spring is a very light [guage] *gauge* metal so that light pressure is applied to one of the tines of the chime after the note is struck. A very light pressure of the damper is essential so that no appreciable extra effort is required to overcome spring force in striking the chime. Positioning the damper assembly toward the clapper head brings the pad into contact with the tines closer to the end where the vibrations are greater, therefore, damping occurs more quickly. Positioning it further away from the clapper head places it into contact with the tine where vibrations are smaller and, therefore, damping time is increased. If no damping is desired and it is desired that tone be sustained, the ringer, after striking, need merely hold the chime slightly back toward the vertical so that the clapper bar bumper lays against the underside of the bumper stop. This lifts the damper away from the tines. In this way, tonal duration may be controlled.

AS A RESULT OF REEXAMINATION, IT HAS BEEN DETERMINED THAT:

The patentability of claims 1–10 is confirmed.

Claim 12 is cancelled.

Claim 11 is determined to be patentable as amended.

11. A hand chime, comprising:

(a) a main tube having two opposite open ends, (b) the first of said ends being forked and having tines, (c) the second of said ends being suitable for grasping as a handle, (d) an adjustable tuning plug within said main tube between said ends dividing said main tube into two sound chambers, and (e) clapper means *integrally* affixed to said main tube by an elastomeric hinge for striking said tines.

* * * * *